US006234078B1

(12) United States Patent
Kessler

(10) Patent No.: US 6,234,078 B1
(45) Date of Patent: May 22, 2001

(54) INK ROLLER ASSEMBLY HAVING A PLURALITY OF SECTIONS EACH HAVING A POROUS SLEEVE

(75) Inventor: John R. Kessler, Dayton, OH (US)

(73) Assignee: Monarch Marking Systems, Inc., Dayton, OH (US)

( * ) Notice: Subject to any disclaimer, the term of this patent is extended or adjusted under 35 U.S.C. 154(b) by 0 days.

(21) Appl. No.: 09/288,436

(22) Filed: Apr. 8, 1999

Related U.S. Application Data

(63) Continuation-in-part of application No. 08/988,256, filed on Dec. 10, 1997, now Pat. No. 5,906,161.

(51) Int. Cl.[7] ..... B41F 31/26

(52) U.S. Cl. ..... 101/351.6; 101/351.7; 101/352.11; 101/329

(58) Field of Search ..... 101/348, 349.1, 101/351.7, 352.1, 352.11, 352.12, 352.13, 351.6, 328, 329, 330, 331, 365, 366; 400/202.4, 200

(56) References Cited

U.S. PATENT DOCUMENTS

| | | | | |
|---|---|---|---|---|
| 2,645,997 | * | 7/1953 | Grede | 101/348 |
| 2,714,851 | * | 8/1955 | Schnackel | 101/329 |
| 3,134,327 | * | 5/1964 | Sebanc | 101/331 |
| 3,167,009 | * | 1/1965 | Sloane | 101/329 |
| 3,738,269 | | 6/1973 | Wagner . | |
| 3,783,083 | | 1/1974 | Jenkins . | |
| 3,812,782 | | 5/1974 | Funahashi . | |
| 3,957,562 | | 5/1976 | Hamisch, Jr. . | |
| 4,227,457 | | 10/1980 | Hamisch, Jr. . | |
| 4,246,842 | | 1/1981 | Williams et al. . | |
| 4,280,863 | | 7/1981 | Hamisch, Jr. et al. . | |
| 4,334,470 | | 6/1982 | Hamisch, Jr. . | |
| 4,399,751 | | 8/1983 | Kessler . | |
| 4,416,201 | | 11/1983 | Kessler . | |
| 4,452,141 | | 6/1984 | Mistyurik . | |
| 4,478,145 | | 10/1984 | Mistyurik . | |
| 5,421,869 | | 6/1995 | Gundjian et al. . | |
| 5,516,362 | | 5/1996 | Gundjian et al. . | |
| 5,774,160 | | 6/1998 | Gundjian . | |
| 5,910,227 | * | 6/1999 | Mistyurik | 156/384 |

FOREIGN PATENT DOCUMENTS 825121 2/1998 (EP) .

* cited by examiner

*Primary Examiner*—Ren Yan
*Assistant Examiner*—Leslie J. Grohusky
(74) *Attorney, Agent, or Firm*—Joseph J. Grass

(57) ABSTRACT

Various embodiments of an ink roller assembly include a capillary ink metering unit and a surrounding porous ink retaining sleeve, wherein the unit is comprised of a pair of capillary sections connected to each other and wherein capillary sections include a hollow shaft and discs with intervening ink capillary chambers interconnected by passages. In another embodiment, a capillary ink metering unit includes discs on a solid shaft, wherein there are passages interconnecting capillary chambers. In yet other embodiments, separate sections are provided to enable inks of different colors, viscosities and/or types to be applied to printing members. There is also provision to meter ink to printing members having different faces or areas in accordance with or as function of the sizes of those areas. The ink roller assembly with separate sections can carry both visible ink and visually alterable ink for coding purposes.

21 Claims, 7 Drawing Sheets

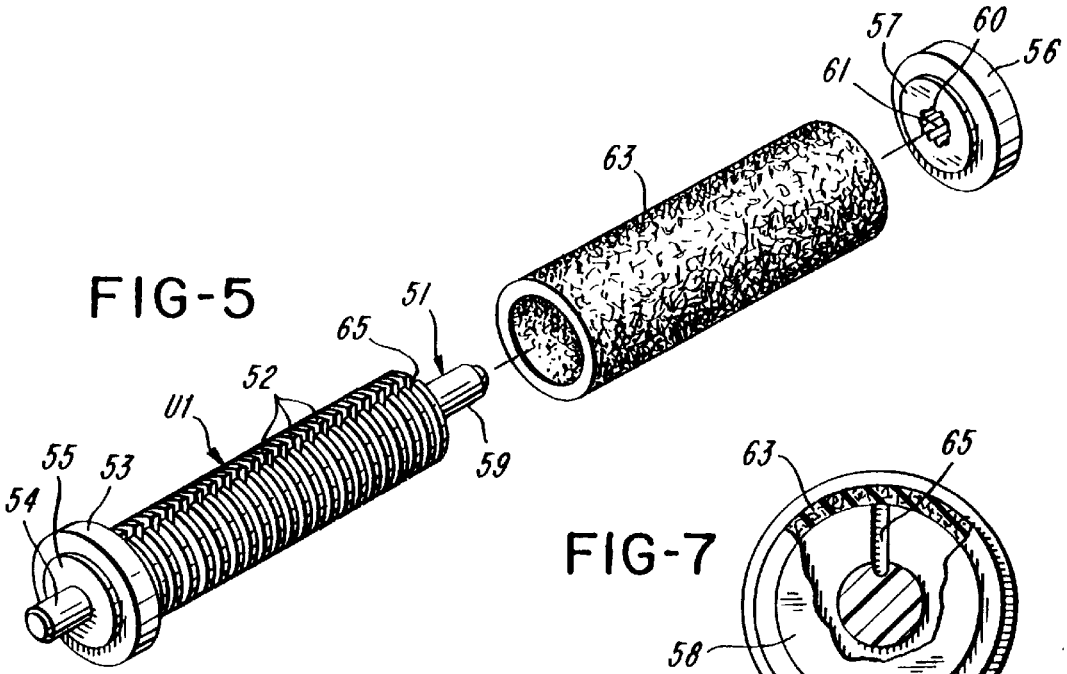
FIG-5
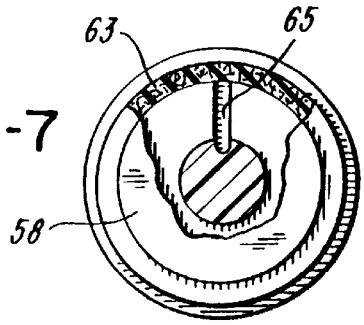
FIG-7
FIG-6
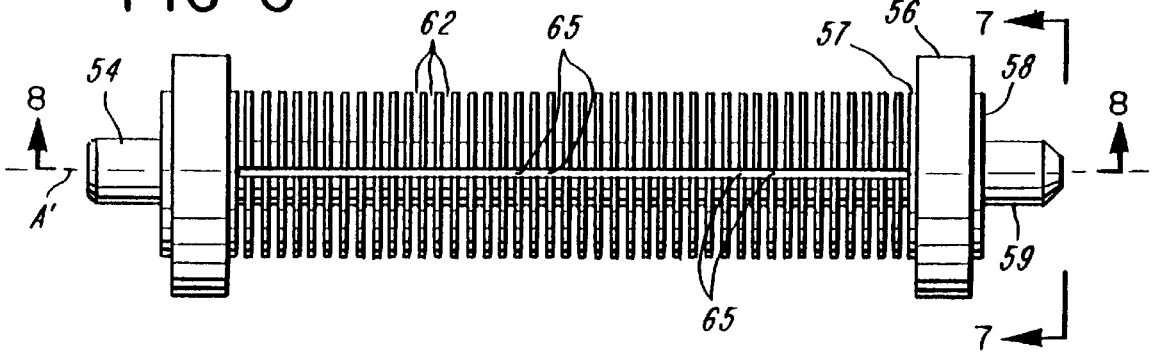
FIG-8
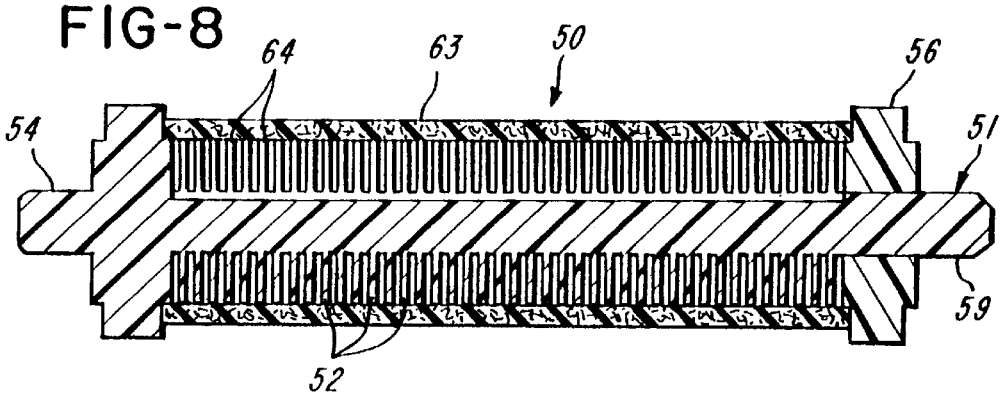

INK ROLLER ASSEMBLY HAVING A PLURALITY OF SECTIONS EACH HAVING A POROUS SLEEVE

CROSS-REFERENCE TO RELATED APPLICATION

This application is a continuation-in-part of U.S. patent application Ser. No. 08/988,256, filed Dec. 10, 1997 now U.S. Pat. No. 5,906,161.

BACKGROUND OF THE INVENTION

1. Field of the Invention

This invention relates to the art of printing and ink roller assemblies.

2. Brief Description of the Prior Art

The following are made of record: U.S. Pat. No. 3,738,269 to W. T. Wagner; U.S. Pat. No. 3,783,083 to W. A. Jenkins; U.S. Pat. No. 3,812,782 to T. Funahashi; U.S. Pat. Nos. 3,957,562; 4,280,863 and 4,334,470 to P. H. Hamisch, Jr. et al; U.S. Pat. No. 4,246,842 to L. E. Willams et al; U.S. Pat. No. 4,399,751 to J. R. Kessler; U.S. Pat. No. 4,416,201 to J. R. Kessler; U.S. Pat. Nos. 4,452,141 and 4,478,145 to J. D. Mistyurik; U.S. Pat. Nos. 5,421,869, 5,516,362 and 5,774,160 to A. Gundjian et al; and U.S. Pat. No. 5,910,227 to J. D. Mistyurik et al.

SUMMARY OF THE INVENTION

It is a feature of the invention to provide an improved ink roller assembly capable of providing a uniform application of ink over an extended period of use.

It is a feature of the invention to provide an improved ink roller assembly which supplies ink in quantities according to the inking requirements for different printing members.

It is a feature of the invention to provide an improved ink roller assembly which holds ink in quantities according to the inking requirements for different printing members.

It is a feature of the invention to provide an improved ink roller assembly which meters ink to printing characters in accordance with or as a function of the surface areas of the printing characters.

It is a feature of the invention to provide an improved ink roller assembly which has capillary sections of different lengths.

In accordance with a specific embodiment of the invention, there is provided an ink roller assembly with a first section comprised of molded plastics material, wherein the first section has a first axial shaft and a series of first discs on the first shaft, and wherein the first discs are closely spaced to provide first capillary chambers. A first porous sleeve is in contact with and spans the outer peripheries of the first discs. There is a second section also comprised of molded plastics material. The second section also has a second axial shaft and a series of second discs on the second shaft. The second discs are closely spaced to provide capillary chambers. There is a second porous sleeve in contact with and which spans the outer peripheries of the second discs. The first and second sections are axially aligned and are connected to each other.

In accordance with another embodiment of the invention, there is a first section with capillary chambers and a porous sleeve and a second section connected to the first section which has a porous sleeve but no capillary chambers.

In another embodiment of the invention, the invention provides an ink roller assembly which can be rotatably mounted on an inker shaft of an inking device. The ink roller has first and second sections connected to each other by a connector. Each of the first and second sections has a flange, a hollow shaft and a series of closely spaced discs which provide capillary chambers for retaining ink. The first section further includes a flexible resilient spring finger for releasably holding the ink roller on the inker shaft. There are preferably passages through the discs which allow for some flow of ink between capillary chambers and pressure equalization. The hollow shafts of the first and second sections have aligned openings for a receiving the inker shaft. The inker shaft has an annular groove for receiving the spring finger. There is a separate flexible resilient porous sleeve of ink retaining material in contact with and spanning the outer peripheries of the discs of both the first and second hub sections.

In yet another embodiment of the invention, a capillary section includes a series of closely spaced discs which provide capillary chambers for retaining ink. Passages interconnect the chambers to provide for some flow of ink between chambers and pressure equalization. A flange is disposed between the discs and a stub end. A porous sleeve of ink-retaining material is in contact with the outer peripheries of the discs.

In all the embodiments, varying the peripheral configurations of the discs can enhance the distribution of ink to the outer surface of the sleeve of ink retaining material.

It is preferred to have different inks in each section of the ink roller. One ink in one section can be a visible ink which can be readily seen following printing without activation or excitation, while the other ink in the other section can be a visible ink activatable or excitable following printing for coding purposes. Alternatively one ink in one section can be of one color and the other ink in the other section can be of a different color. In the event an ink is used which is visible but becomes invisible following printing, such an ink is considered to be an invisible ink in the context of this disclosure.

According to a specific embodiment, there is provided an improved method of printing on a record member, which comprises providing a print head with first and second printing members, providing an ink roller with a first porous ink-receptive sleeve containing a visible first ink and a second porous ink-receptive sleeve containing a visually alterable second ink, rolling the ink roller across the first and second printing members to cause the first sleeve to ink the first printing member with the first ink and to cause the second sleeve to ink the second printing member with the second ink, and simultaneously printing with the inked first and second printing members to produce printing with both the first and second inks on a record member.

BRIEF DESCRIPTION OF THE DRAWINGS

FIG. 5 is an exploded perspective view of an ink roller assembly in accordance with another embodiment of the invention;

FIG. 6 is a top plan view of the ink roller assembly of FIG. 5, but omitting the sleeve;

FIG. 7 is a partly broken away end elevational view taken along line 7—7 of FIG. 6;

FIG. 8 is a vertical sectional view of the ink roller assembly taken along line 8—8 of FIG. 6;

DETAILED DESCRIPTION OF THE PREFERRED EMBODIMENTS

Figure 1:
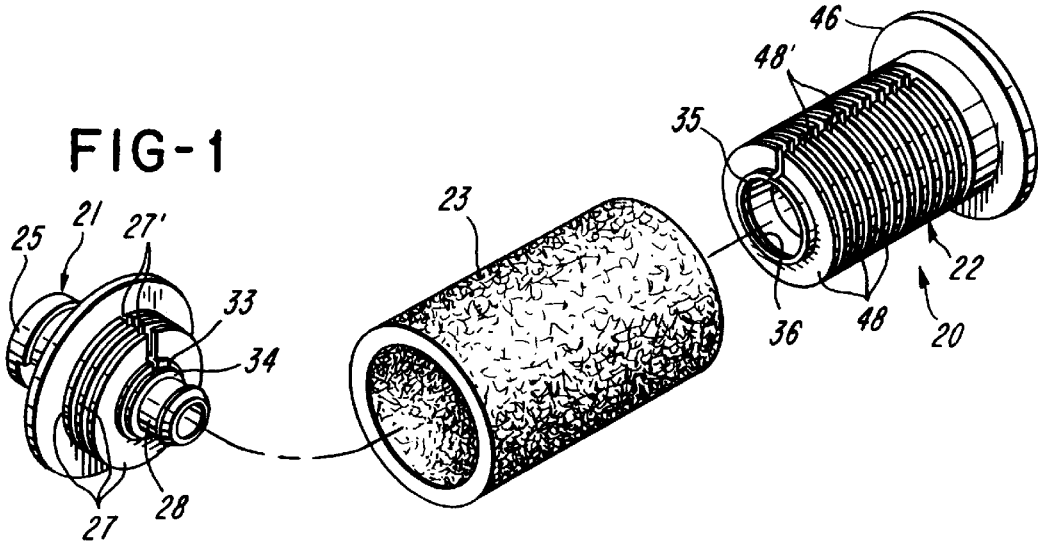
FIG. 1 is a rotated exploded perspective view of an ink roller assembly in accordance with one embodiment of the invention.
Figure 2:
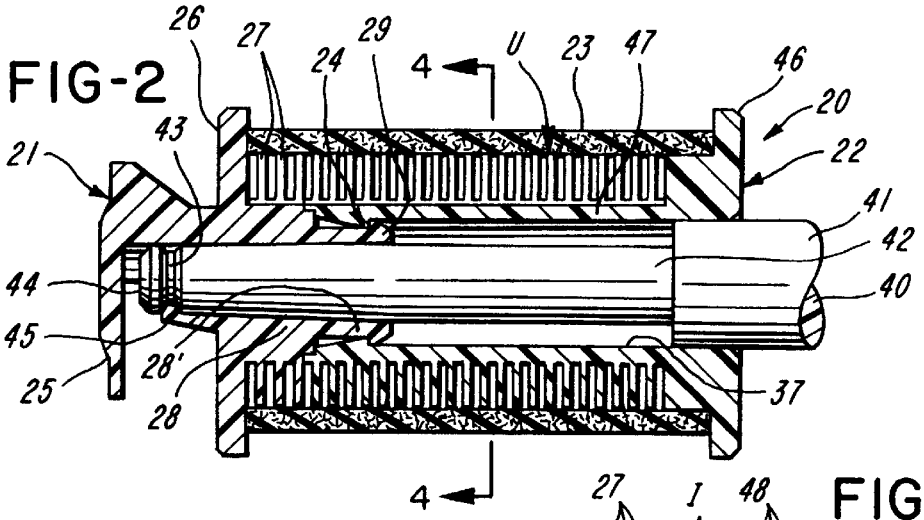
FIG. 2 is an assembled mainly sectional view of the ink roller assembly of FIG. 1 mounted on an inker shaft of an inking mechanism.
Figure 3:
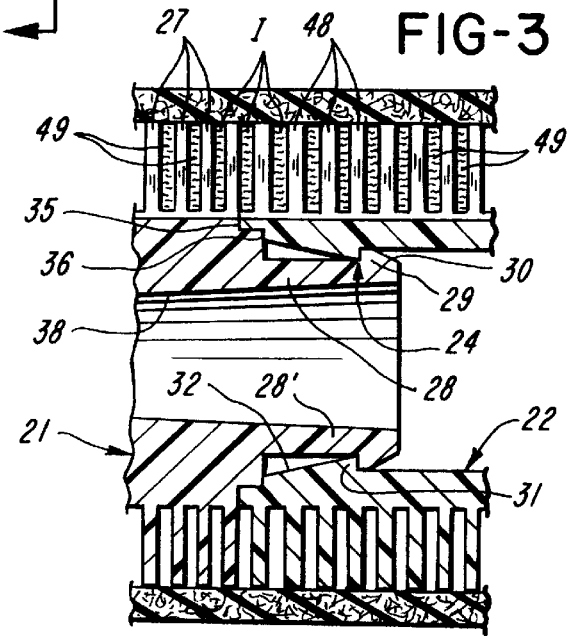
FIG. 3 is an enlarged fragmentary sectional view of a portion of the ink roller assembly shown in FIGS. 1 and 2.
Figure 4:
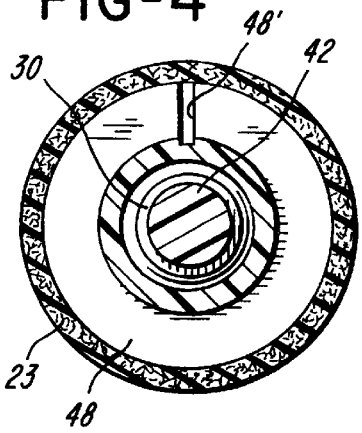
FIG. 4 is a sectional view taken along line 4—4 of FIG. 2.

Referring to the embodiment of FIG. 1 through 4, there is shown an ink roller assembly generally indicated at 20. The assembly is shown to include a first capillary section 21, a second capillary section 22 and a porous ink retaining sleeve 23. The capillary section 21 is connected to the capillary section 22 by a connector generally at 24. The capillary sections 21 and 22 provides a capillary ink metering unit U. The capillary section 21 has a handle 25, a flange or bearing roll 26, a series of closely spaced discs 27 and a shaft portion or hub 28 with a connector portion 28'. The shaft portion 28 has a tapered bore 38. The connector portion 28' of the connector 24 is annular and has an annular external bead or tooth 29 with a lead-in or taper 30. The capillary section 22 has an annular internal bead or tooth 31 and a lead-in or taper 32. The capillary section 21 also has two abutment faces 33 and 34 which cooperate with respective abutment faces 35 and 36 on the capillary section 22. The connector 24 is of the snap-type so that when the connector portion 28' is moved into bore or passage 37, the connector portion 28' snaps into a locked position with the annular bead 31. In the locked position, the abutment faces 33 and 35, and 34 and 36 abut each other. Because of this construction there is an ink-tight seal between ink I and the bore or passage 37 on the inside of the hub section 22. Thus, ink I will not migrate onto grooved inker shaft 40 of an inking mechanism (not shown) but shown in U.S. application Ser. No. 08/701,259 filed Aug. 22, 1996, incorporated herein by reference. The shaft 40 is shown to be stepped with a large diameter portion 41 and a small diameter portion 42. The small diameter portion 42 has an annular external groove 43 near its terminal end 44. The capillary section 21 has an integral flexible resilient spring finger 45 shown to be engaged in the groove 43. To insert an ink roller assembly 20 onto the shaft 40, the ink roller assembly 20 is slid onto the shaft 40 until the spring finger moves into the groove 43. To remove the ink-roller assembly 20, the user grasps the handle 25 and pulls the ink roller assembly 20 off the shaft 40.

The capillary section 22 has a flange 46 and a hollow shaft portion or hub 47 with a series of outwardly extending closely spaced discs 48. The discs 27 and 48 provide a long series of capillary chambers 49 extending between the flanges 26 and 46. Supported by the discs 27 and 48 is the flexible resilient ink-retaining porous sleeve 23. The sleeve 23 is under hoop-tension and makes direct contact with and spans across the outer peripheries of the discs 27 and 48. Some of the capillary chambers 49 are on the capillary section 21, but a greater number of the capillary chambers 49 on the capillary section 22.

The capillary sections 21 and 22 have passages 27' and 48' through the discs 27 and 48 in the form of radical slots or cutouts. The passages 27' and 48' provide for some flow of ink between the passages and pressure equalization within and between the chambers 49.

With reference to FIG. 5, there is shown another embodiment of ink roller assembly generally indicated at 50. The assembly 50 is shown to include a shaft or shaft portion generally indicated at 51, closely spaced discs 52 on the shaft 51, a flange 53 on the shaft 51 and a stub end 54 which is a part of the shaft 51. The flange 53 has an integrally molded annular projection or shoulder 55. It is preferred that the shaft 51 and its stub end 54, the discs 52, the flange 53 and the shoulder 55 be of one-piece molded plastics construction and provide a capillary ink retaining unit U1. The flange 53 is disposed between the discs 52 and the stub end 54. A flange or disc 56 having opposed projections 57 and 58 is shown to have been press-fitted onto the shaft 51 in FIG. 5 through 8. An end portion of the shaft 51 is considered to be a stub end 59. The flange 56 has an annular central hole 60 provided with straight flutes 61 which compress when the stub end is received in the hole 60. The flange 56 is likewise of one-piece molded plastics construction.

There is ink in capillary chambers 62 between the discs 52. A flexible resilient porous ink-retaining sleeve 63 is shown in FIG. 8 to be in contact with outer peripheries 64 of the discs 52. The sleeve 63 is in hoop tension. As shown, there are passages 65 between the discs 52. Each passage 65 is shown to be a radial through-cut or slot. The passages 65 are shown to be aligned in the axial direction. The shaft 51 is shown to have an axis A' and the discs 52 are coaxial with the axis A'. The passages 65 provide for equalization of the pressure between the capillary chambers 62 and also promote some flow of ink between adjacent chambers 62 and to the sleeve 63. This is beneficial both when charging the chambers 62 and the sleeve 63 with ink I and during use of the ink roller assembly 50.

The charging of the chambers 49, 62 or 74 can be performed by placing the unit U or U1 and the respective sleeve 23, 63 or 75 in a vat of ink and drawing a vacuum; and this charging can be accomplished either when the unit U or U1 and the respective sleeve 23, 63 or 75 are apart or when they are assembled.

Figure 9:
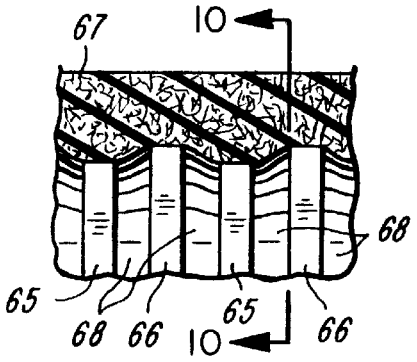
FIG. 9 is a fragmentary sectional view showing an alternative construction for the discs of the embodiments of FIGS. 1 through 8.
Figure 10:
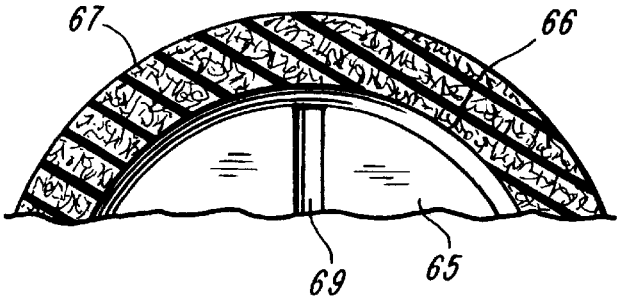
FIG. 10 is a sectional view taken along line 10—10 of FIG. 9.

With reference to FIGS. 9 and 10, there is shown an alternative form of discs 65 and 66. The discs 27, 49 and 52 can be modified as disclosed in FIGS. 9 and 10. The discs 65 and 66 have different outside diameters, with the discs 66 having a slightly larger diameter than the discs 65. A sleeve 67 is like the sleeves 23 and 63 in that it is under hoop tension and is ink receptive. The purpose of the different diameters is to promote the transference of ink from the capillary chambers 68 to the sleeve 67. There are aligned passages 69 through the discs 65 and 66 as shown in FIGS. 9 and 10. By way of example not limitation, the difference in the diameters of the discs 65 and 66 is on the order of 0.005 inch.

Figure 11:
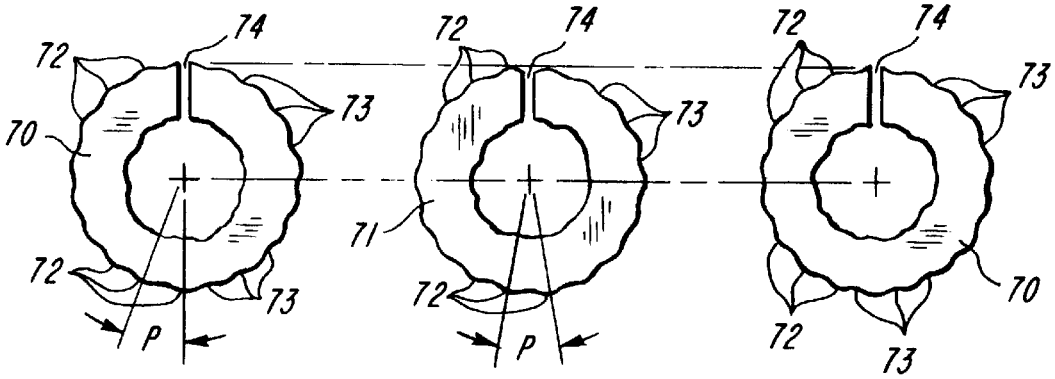
FIG. 11 is a developed fragmentary view showing another manner in which the discs of the embodiments of FIGS. 1 through 8 can be constructed.
Figure 12:
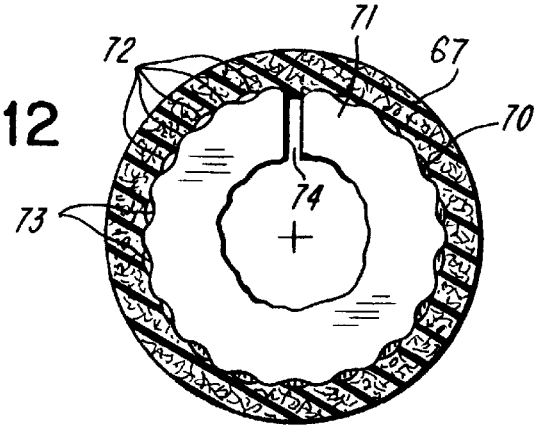
FIG. 12 is an assembled sectional fragmentary view of an alternative form of ink roller assembly.

FIG. 11 shows a developed view of a series of discs in which alternate discs 70 and 71 have undulating peripheries having high points 72 and low points 73. The discs 70 and 71 also have passages 74 like the passages 49 and 62. By way of example not limitation, the high points 72 have a pitch P of 20 degrees and consequently the low points also have a pitch of 20 degrees. Thus, there are eighteen high points and eighteen low points per disc. Every other disc 70 and 72 is offset as illustrated in FIGS. 11 and 12. FIG. 11 shows the high points 72 of the discs 70 aligned, and out of alignment with the high point 72 of the disc 71. The provision of discs with a variable peripheral edge configuration as shown in FIGS. 11 and 12 is applicable to the embodiment of FIGS. 1 through 4, the embodiment of FIGS. 5 through 8, the embodiment of FIGS. 13 through 16, and the embodiments of each of FIGS. 17, 19 and 20. Such variable edge configurations promote flow of ink from capillary passages 66 to the porous sleeve 67.

Figure 14:
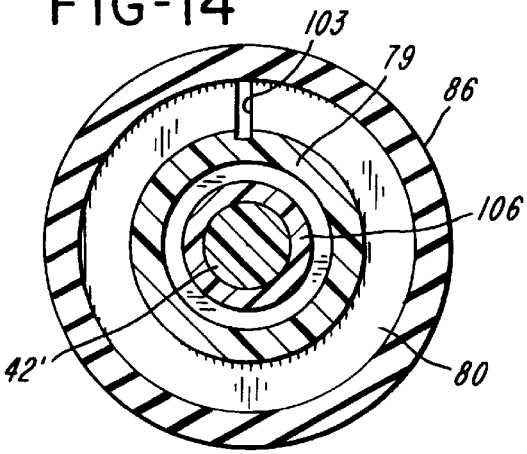
FIG. 14 is a sectional view taken generally along line 14—14 of FIG. 13.
Figure 15:
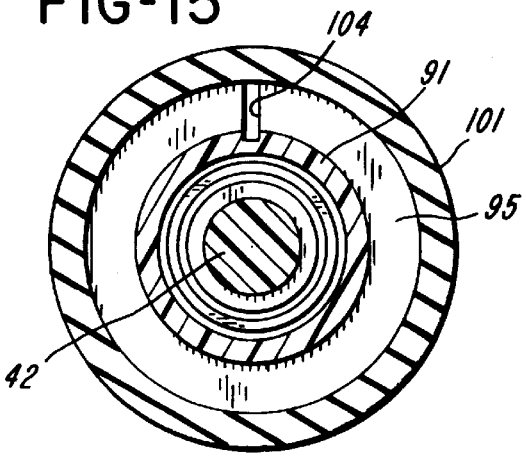
FIG. 15 is a sectional view taken generally along line 15—15 of FIG. 13.
Figure 16:
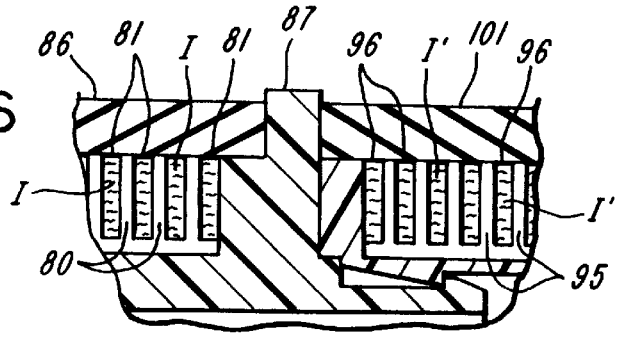
FIG. 16 is a fragmentary sectional view of a portion of the ink roller assembly of the embodiment of FIGS. 13 through 16.

With reference to the embodiment of FIGS. 13 through 16, there is shown an ink roller assembly generally indicated at 75 rotatably mounted on the shaft 40. The ink roller assembly 75 is shown to have sections 76, 77 and 78. The section 77 has a shaft or shaft portion 79 and a series of parallel discs 80 extending radially outwardly from the shaft 79. The discs 80 are closely spaced to provide a series of capillary chambers 81. The discs 80 are located between flanges 82 and 83 which provide annular lands 84 and 85. A porous ink-receptive sleeve 86 is received about or spans the discs 80 and the flanges 82 and 83. Ink I shown by short generally horizontal lines in FIG. 16 is received in the capillary chambers 81 and in the porous sleeve 86. The sections 77 and 78 can be considered to be ink-carrying sections. The sleeve 86 before being applied over the section 77 has a small inside diameter than the outside diameters of the discs 80 and the flanges 82 and 83 so that the sleeve 86 is under slight tension. The sleeve 86 seals against the lands 84 and 85 to obviate ink I escaping from adjacent capillary chambers 81. The section 77 also has a flange or flange portion 87 against which one end of the sleeve 86 abuts. As is apparent from FIGS. 13, 14 and 15, the shaft 79, the discs 80, the flanges 82, 83 and 87 and the sleeve 86 are annular. The shaft 79 is shown to be hollow with a larger inside diameter than the outside diameter of the shaft portion 42. One marginal end portion 88 of the shaft 79 is tubular and has an annular external tooth 89 which is tapered or has a lead-in as shown at 90. The entire section 77 is of one-piece molded plastics construction.

The section 78 has a shaft or shaft portion 91 which has an annular internal tooth 92 which engages the tooth 89 to hold the sections 77 and 78 securely to each other. The plastics material of which the sections 77 and 78 are constructed can yield resiliently to enable the tooth 89 to snap over the tooth 92 during connection of the sections 77 and 78. The teeth 89 and 92 hold the sections 77 and 78 securely locked to each other. The teeth 89 and 92 provide a snap-fit connection. The shaft 91 has a notch 93 which receives an abutment or shoulder 94 on the shaft 79. The section 78 also has a series of closely spaced parallel discs 95 which provide a series of capillary chambers 96. The capillary chambers 96 are disposed between the flanges 97 and 98 which provide respective lands 99 and 100. A porous ink-receptive sleeve 101 is received about the discs 95 and the flanges 97 and 98. Lands 99 and 100 provide a seal against seepage of ink I'. The sleeve 101, like the sleeve 86, has a lesser inside diameter than the outside diameter of the discs 95 and flanges 97 and 98 before assembly onto the section 78 and is thus under slight tension. The sleeve 101 abuts against flanges 87 and 102.

As best shown in FIG. 14, there are aligned passages 103 through all the discs 80 and as best shown in FIG. 15 there are aligned passages 104 through all the discs 95 for reasons stated above.

The section 76 has similarities to the section 21 although it does not have any capillary passage. The section 76 has a shaft or shaft portion 105 with a tubular marginal end portion 106 having an annular external tooth 107. The tooth 107 has a taper or lead-in 108. A flexible resilient spring finger 109 projects outwardly from the other end of the shaft 105. The shaft 79 has an annular internal tooth 110 which engages the annular tooth 107. The tooth 110 has a taper or lead-in 111. The plastics material of which the sections 76 and 77 are constructed can yield resiliently to enable the tooth 107 to snap over the tooth 110 during connection of the sections 76 and 77. The teeth 107 and 110 hold the sections 76 and 77 securely locked to each other. The teeth 107 and 110 provide a snap-fit connection. The shaft 79 also has notches 112 and 113 which receive respective shoulders 114 and 115. The teeth 107 and 110 hold the sections 76 and 77 securely locked to each other. The section 76 also has a flange 116 which abuts the flange 82 and one end of the sleeve 86. The other end of the sleeve 86 abuts the flange 87. The section 76 also has a handle 117.

The shaft 40 also has a tapered portion 42' which is in contact with tapered inner surface 118 of the hollow shaft 105. Reduced portion 42 of the shaft 41 is received within and spaced from shafts 79 and 91.

The flanges 102 and 116 serve as bearing rolls which roll along rails 119 and 120 of a print head generally diagrammatically indicated at 121. The print head 121 is shown spaced from the ink roller assembly 75 for clarity. When the flanges 102 and 116 roll across the rails 119 and 120 the sleeves 86 and 101 ink respective rows of printing characters 122 and 123.

FIG. 16 shows the inks I and I' represented by short wavy lines. The inks I and I' can be different from each other in a variety of ways because the capillary chambers 81 and the sleeve 86 are isolated respectively from the capillary chambers 96 and the sleeve 101. For example, the inks I and I' can differ in color, viscosity and/or type. For example one ink I can be black and the ink I' can be red. The ink I can be of a type which is visible to the human eye under conditions of ordinary lights and the ink I' can be a security ink invisible to the human eye under conditions of ordinary light but can become visible when excited as by a chemical or by, for example, ultraviolet light. In U.S. Pat. No. 5,774,160 to A. Gundjian, the disclosure of which is incorporated herein by reference, in EXAMPLE 2, the latent image is made visible by a developer. In another example, the entire record member to be printed is coated with a first coating and an excitable ink I' is printed over the first coating, as in U.S. Pat. No. 5,421,869 to A. Gundjian, the disclosure of which is incorporated herein by reference. See also U.S. Pat. No. 5,516,362 to A. Gundjian, the disclosure of which is incorporated herein by reference. A difference of viscosity between the inks I and I' will affect the rates at which ink is applied by the sleeves 86 and 101. It should be appreciated that inks I and I' are not shown by short wavy lines in FIGS. 13, 14 and 15 for the sake of clarity.

Figure 13:
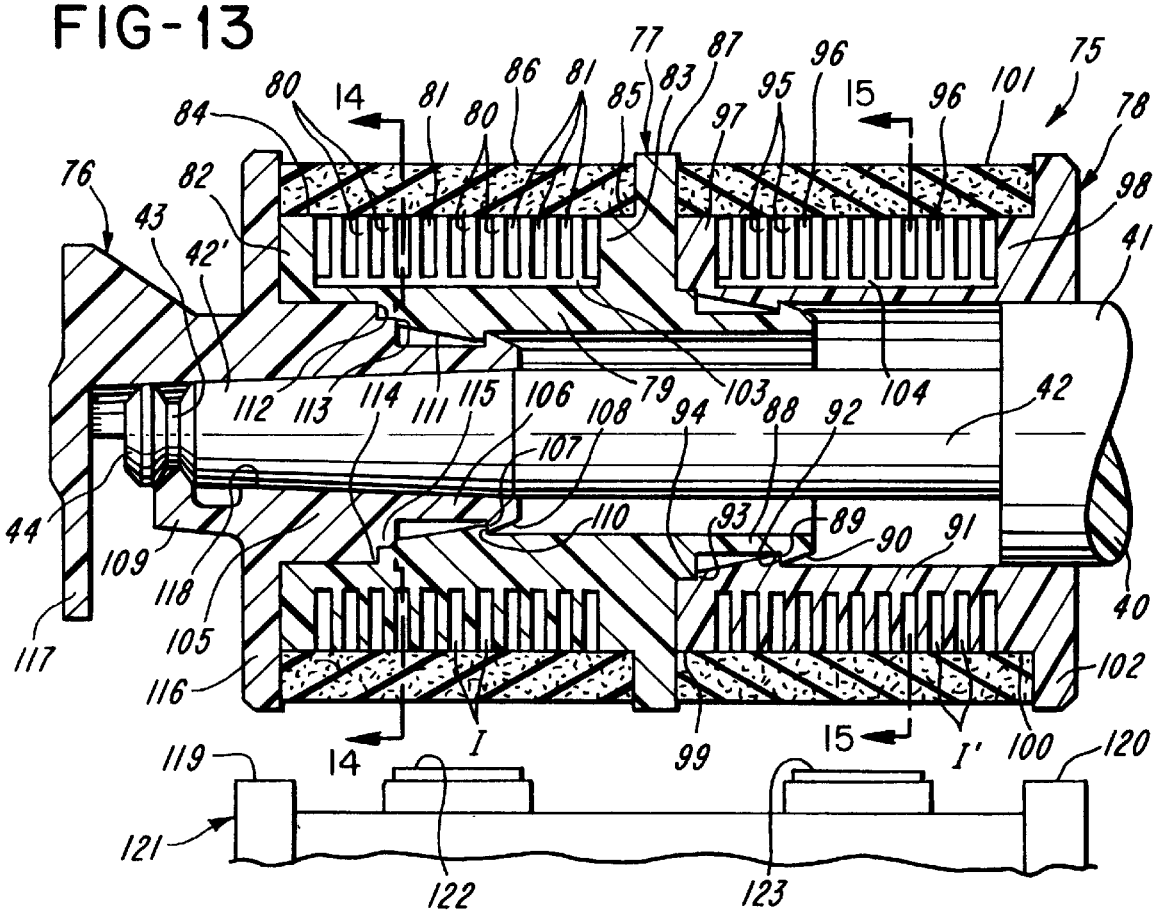
FIG. 13 is an assembled mainly sectional view of another embodiment of an ink roller assembly mounted on an inker shaft.

It is evident from FIG. 13 that each of the sections 77 and 78 has the same number of capillary chambers, namely, eleven and that the sleeves 86 and 101 are the same size. It is also evident that the printing characters 121 and 122 are the same size or area, and therefore generally the same amount of ink is required for each of the characters 122 and 123. The ink capacity of the section 77 and the sleeve 86 and the ink capacity of the section 78 and the sleeve 101 are the same.

Figure 17:
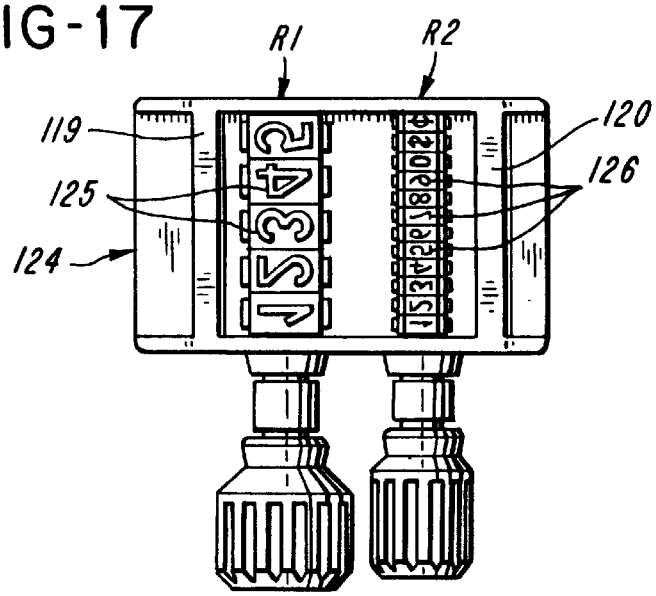
FIG. 17 is a bottom plan view of a print head with a row of small dialable printing characters and a row of large dialable printing characters.
Figure 18:
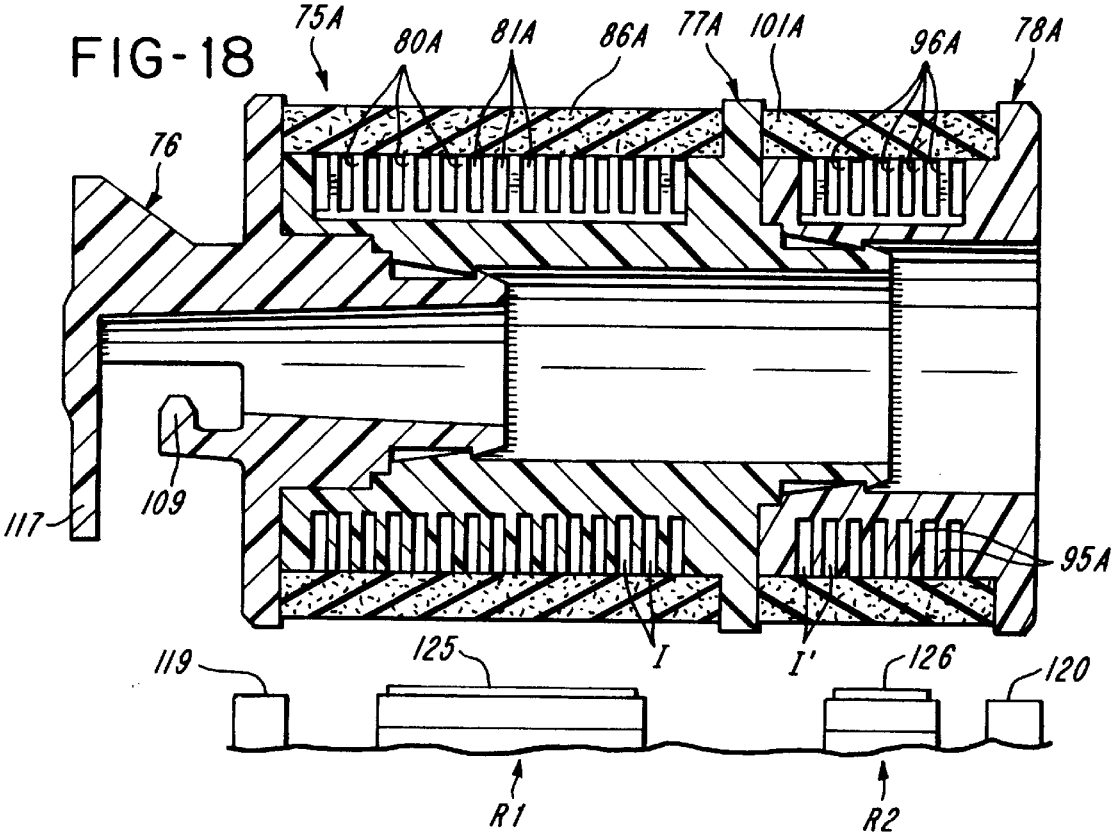
FIG. 18 is a view similar to FIG. 13, but without the inker shaft, and showing an alternative embodiment of the invention.
Figure 19:
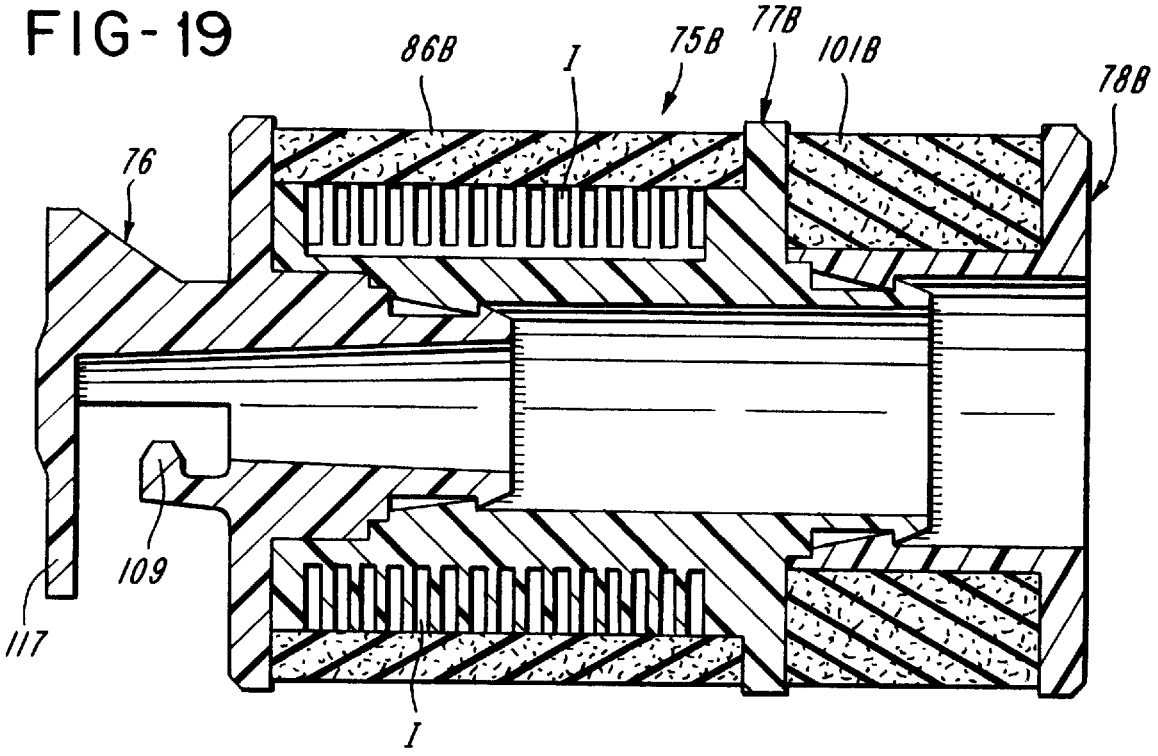
FIG. 19 is a view similar to FIG. 18, but showing another alternative embodiment of the invention.
Figure 20:
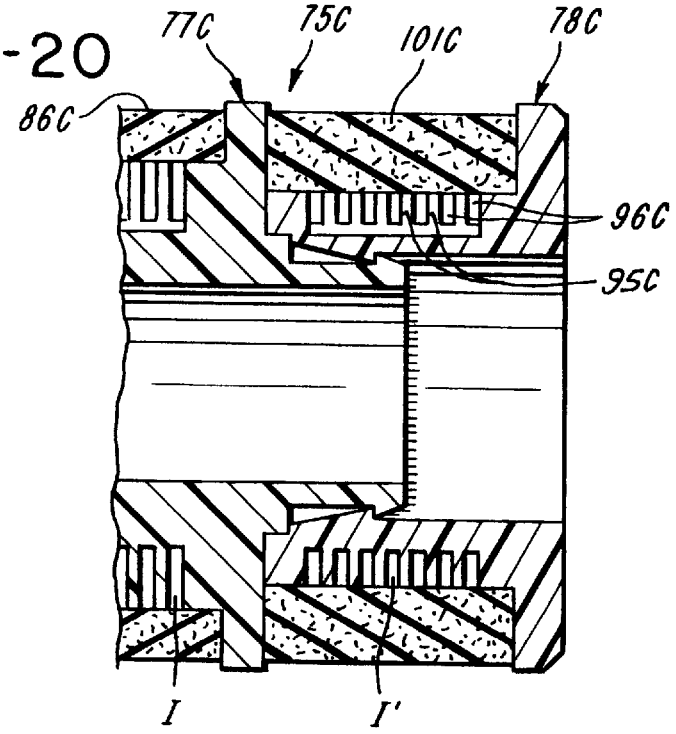
FIG. 20 is a view similar to FIG. 17, but showing a fragmentary portion of yet another alternative embodiment.

When it is desired to ink a print head such as the print head 124 shown in FIG. 17, wherein the areas of the printing characters 125 of one row R1 differ from the areas of the printing characters 126 of the other row R2, according to the invention the ink capacity and/or the ink delivery rate of the sections is desirably tailored to the ink requirements of the characters 125 and 126 as also is evident in each of the embodiments of FIGS. 18, 19 and 20.

Print heads 121 and 124 are preferably arranged relative to the ink roller of the invention so that the sleeve of each section is aligned with and inks one line of printing characters. Such an arrangement is disclosed in U.S. Pat. No. 4,280,863. In this arrangement the axis of the ink roller extends in a direction perpendicular to the direction in which both lines of printing characters extend. Details of a typical two-line print head are disclosed in U.S. Pat. No. 4,334,470.

The embodiment of FIG. 18 is the same as the embodiment of FIGS. 13 through 16 except that section 77A is longer (larger) than section 77, and section 78A is (smaller) than section 78. Section 77A has a larger ink capacity and number of discs 80A and capillary chambers 81A and ink capacity than Section 77, namely, the section 77A has fifteen capillary chambers 81A. Section 78A has a smaller ink capacity and number of disc 95A and capillary chambers 96A and ink capacity than section 78. Also, the sleeve 86A is longer than the sleeve 86, and the sleeve 101A is shorter than the sleeve 101. It is evident that the sleeve 86A is longer than the sleeve 101A. Thus, because of the different amounts of ink required for the printing characters 125 and 126 over the life of the ink roller assembly 75A based on the different areas of the respective printing characters 125 and 126, the ink capacities of the sections 77A and 78A are made to correspondingly large and small respectively. The ink roller assembly 75A is identical in all other respects to the ink roller assembly 75 of the embodiment of FIGS. 13 through 16. In the embodiment of FIG. 18, the same reference characters are used wherever possible to designate like or similar components with the addition of the letter "A".

In the embodiment of FIG. 19, the section 77B is identical to section 77A. The difference between sections 78A and 78B is that section 78A has discs 95 and capillary chambers 96A, whereas section 78B has no capillary chamber. The sleeve 101B is thicker than the sleeve 101 or 101A and consequently contains more ink. However, the sleeve 101B contains less ink than the amount of ink I in sleeve 101A taken together with the amount of ink I' in capillary chambers 96A. The ink roller assembly 75B is identical to the ink roller assembly 75A in all other respects. In the embodiment of FIG. 19, the same reference characters are used wherever possible to designate like or similar components with the addition of the letter "B".

The ink roller assembly 75C is the same as the ink roller assembly 75A, except that section 78C has shorter discs 95C and capillary chambers 96C containing less ink than the capillary chambers 96A and the sleeve 101C is thicker than sleeve 101A. The difference between the embodiments of FIGS. 18 and 20 is that the combined amounts of ink contained in the sleeve 101A and the capillary chambers 96A is greater than the combined amounts of ink contained in the sleeve 101C and capillary chambers 96C. In the embodiment of FIG. 20, the same reference characters are used wherever possible to designate like or similar components with the addition of the letter "C".

It should be noted that the sections 77A, 77B and 77C are identical.

Figure 21:
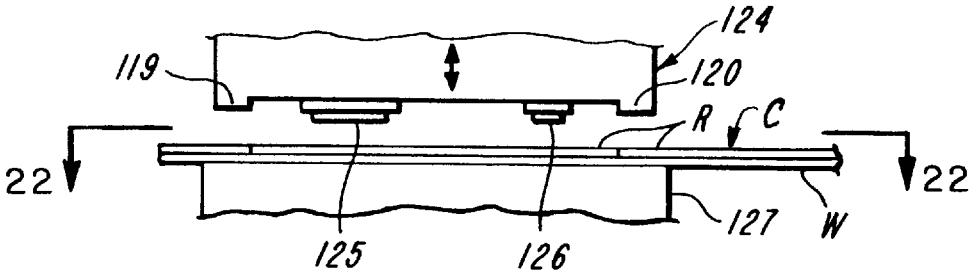
FIG. 21 is an elevational view of a print head and platen and an intervening web of record members.

With reference to FIG. 21, there is shown the print head 124 and a stationary platen 127. A composite web C has record members R releasably secured to a carrier web W by pressure sensitive adhesive 128'. The record members R are labels, but may be tags, if desired. The printing characters 125 and 126 are inked by the respective inks I and I' of any of the ink roller assemblies 75A, 75B or 75C. In the event the printing characters 125 are inked with a visible human readable ink I and the printing characters 126 are inked with invisible ink I', the printing caused by the printing characters will not be visible when printed on the record members R without excitation or activation of the invisible ink I'.

In order to ink the printing characters 125 and 126, the print head 124 is moved away from the platen 127 to a greater extent than shown in FIG. 21. The ink roller assembly 75A, 75B or 75C is then rolled on the rails 119 and 120 to ink the printing characters 125 and 126 simultaneously with respective inks I and I'. Assuming that the record member R to be printed is in the printing position between the print head 124 and the platen 127, the inked print head 124 is moved into cooperation with the platen 127 and the intervening record member R.

Figure 22:
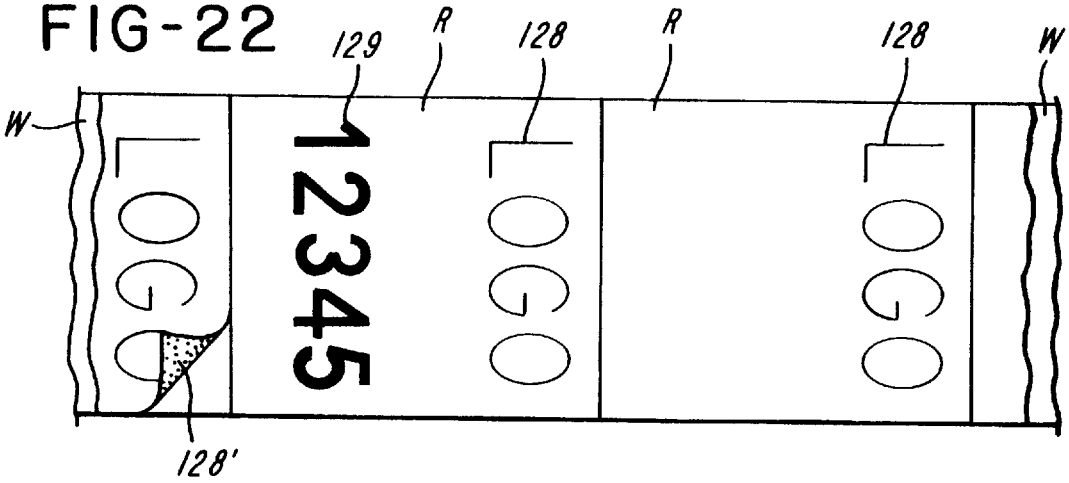
FIG. 22 is a view taken along line 22—22 of FIG. 21.

With reference to FIG. 22, indicia 128 have been preprinted on the record members R. The indicia 128 may take any desired form, such as a store name or logo. When the printing characters 125 print on the record member R, the resultant printing 129 is visible to the human eye under ordinary lighting conditions as shown in FIG. 22, but the printing caused by the characters 126 is not visible (and therefore not shown in FIG. 22) because, in the preferred embodiment, invisible ink I' is used.

Figure 23:
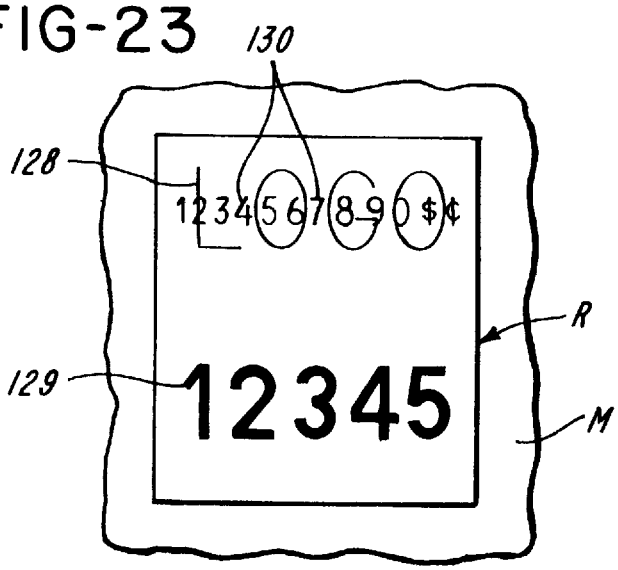
FIG. 23 is a top plan view of a label printed according to the method of the invention, but showing a code which has been activated.

FIG. 23 shows one of the printed record members R applied to merchandise M. The printing 130 made by printing members 126 inked with invisible ink I' is superimposed on the indicia 128 and is visible upon excitation or activation, as illustrated.

In the various embodiments of FIGS. 13 through 16, 18, 19 and 20, the sleeves are assembled onto their respective sections in subassemblies, namely, section 77 and sleeve 86, section 78 and sleeve 101, section 77A and sleeve 86A, section 77B and sleeve 86B, section 78B and sleeve 101B, section 77C and sleeve 86C, and section 78C and sleeve 101C, and each such subassembly is inked as by placing it in a tank of ink and then drawing and thereafter releasing a vacuum so that the respective capillary chambers and porous sleeves are inked. There is a different tank for each type of ink. The differently inked subassemblies are snapped together following such inking.

Various components are referred to as first, second and third, but such language does not have any special meaning or importance aside from distinguishing one part from the other for ease of understanding.

By way of example, not limitation, it is preferred that the spacing between the discs of the above disclosed embodiments be less than 0.02 inch and most preferably about 0.016 inch. The passages 27', 48', 65 and 74 are about 0.006 inch in width and extend from the shaft to the outer peripheries of the discs 27, 48, 52, 70 and 71. The discs 27, 48, 52, 70 and 71 are preferably about 0.012 inch in thickness.

Other embodiments and modifications of the invention will suggest themselves to those skilled in the art, and all such of these as come within the spirit of this invention are included within its scope as best defined by the appended claims.

What is claimed is:

1. An ink roller assembly, comprising: a first section comprised of molded plastics material, the first section having a first axial shaft and a series of first discs on the first shaft, the first discs being closely spaced to provide first capillary chambers, the first discs having outer peripheries, a first porous sleeve in contact with and spanning the outer peripheries of the first discs, a second section comprised of molded plastics material, the second section having a second axial shaft and a series of second discs on the second shaft, the second discs being closely spaced to provide second capillary chambers, ink in the first and second capillary chambers, the second discs having outer peripheries, a second porous sleeve in contact with and spanning the outer peripheries of the second discs, and the first and second sections being axially arranged and connected to each other.

2. An ink roller as defined in claim 1, wherein the second section is shorter than the first section.

3. An ink roller assembly as defined in claim 1, wherein the first section has a greater ink capacity than the second section.

4. An ink roller assembly as defined in claim 1, wherein the viscosity of the ink in the first section differs from the viscosity of the ink in the second section.

5. An ink roller assembly as defined in claim 1, wherein the color of the ink in the first section differs from the color of the ink in the second section.

6. An ink roller assembly as defined in claim 1, wherein the number of first capillary chambers is greater than the number of second capillary chambers.

7. An ink roller assembly as defined in claim 1, wherein the size of the first capillary chambers differs from the size of the second capillary chambers.

8. An ink roller assembly as defined in claim 1, wherein the size and number of first capillary chambers is greater than both the size and number of second capillary chambers.

9. An ink roller assembly as defined in claim 1, wherein the first sleeve is longer than the second sleeve.

10. An ink roller assembly as defined in claim 1, including a snap-fit connection between the first and second sections.

11. An ink roller assembly as defined in claim 1, wherein the first and second shafts are connected to each other.

12. An ink roller assembly as defined in claim 1, wherein the first sleeve and the first capillary chambers are provided with visible ink and the second sleeve and the second capillary chambers are provided with an invisible ink.

13. An ink roller assembly as defined in claim 1, wherein the second sleeve and the second capillary chambers are provided with a visibly alterable ink.

14. An ink roller assembly as defined in claim 1, the first and second shafts being hollow, a third section comprised of molded plastics material, the third section being connected to one of the first and second sections and including a flexible resilient spring finger to releasably retain the ink roller on a shaft received within the hollow first and second shafts.

15. An ink roller assembly as defined in claim 14, wherein the third section includes a flange adjacent to one of the sleeves.

16. For an ink roller assembly, a first section comprised of molded plastics material, the first section having a first axial shaft and a series of first discs on the first shaft, the first discs being closely spaced to provide first capillary chambers, a second section comprised of molded plastics material, the second section having a second axial shaft and a series of second discs on the second shaft, the second discs being closely spaced to provide second capillary chambers, wherein the first section is longer than the second section, and wherein the first and second sections are axially arranged and are connected to each other.

17. For an ink roller assembly as defined in claim 16, including a flange between the first and second capillary chambers.

18. For an ink roller assembly as defined in claim 16, wherein one of the first and second sections includes a flexible resilient spring finger.

19. An ink roller assembly, comprising: a first section comprised of molded plastics material, the first section having a first axial shaft and a series of discs on the first shaft, the discs being closely spaced to provide capillary chambers, the discs having outer peripheries, a first porous sleeve in contact with and spanning the outer peripheries of the discs, a second axial section comprised of molded plastics material and connected to the first section, the second section having a second porous sleeve, wherein the first sleeve and the capillary chambers and the second sleeve contain ink.

20. An ink roller assembly as defined in claim 19, wherein the ink in the first sleeve and the capillary chambers differs from the ink in the second sleeve.

21. An ink roller assembly as defined in claim 19, wherein the first and second sections are connected by a snap-fit connection.

* * * * *